US005946770A

United States Patent [19]

Bijma et al.

[11] Patent Number: 5,946,770

[45] Date of Patent: Sep. 7, 1999

[54] VACUUM CLEANER COMPRISING AN ODOR FILTER

[75] Inventors: Jan Bijma; Robert H. Munnig Schmidt; Johannes A.T. Driessen, all of Hoogeveen, Netherlands

[73] Assignee: U.S. Philips Corporation, New York, N.Y.

[21] Appl. No.: 08/751,630

[22] Filed: Nov. 18, 1996

[30] Foreign Application Priority Data

Nov. 24, 1995 [FR] France ..... 95 203238

[51] Int. Cl.[6] ..... A47L 5/00

[52] U.S. Cl. ..... 15/339; 15/319

[58] Field of Search ..... 15/319, 339

[56] References Cited

U.S. PATENT DOCUMENTS 4,063,326 12/1977 Fromknecht ..... 15/339

FOREIGN PATENT DOCUMENTS 63-159850 1/1990 Japan .

*Primary Examiner*—Diana L. Oleksa

*Attorney, Agent, or Firm*—Ernestine C. Bartlett

[57] ABSTRACT

A vacuum cleaner, has a housing and a suction motor, arranged in the housing. When in operation, the motor draws in air via a suction opening and discharges the air via at least one outlet opening in the housing. A dust chamber in the housing collects dust entrained by the drawn-in-air when the vacuum cleaner is in operation. An odor filter is arranged in the housing downstream of the dust chamber. The odor filter includes a unit which temporarily prolongs the residence time of air drawn through the odor filter, in the odor filter during an odor suppression cycle.

17 Claims, 1 Drawing Sheet

VACUUM CLEANER COMPRISING AN ODOR FILTER

BACKGROUND OF THE INVENTION

1. Field of the Invention

The invention relates to a vacuum cleaner having a housing; a suction motor, arranged in the housing, which when operated draws in air via a suction opening and discharges the air via at least one outlet opening in the housing; a dust chamber in the housing, in which dust entrained by the drawn-in air is collected in operation; and an odor filter arranged in the housing downstream of the dust chamber.

2. Description of the Related Art

Such a vacuum cleaner is known from practice. The odor filter absorbs malodorous gases present in the exhausted air. These gases may be produced when the vacuumed-up material contains decaying substances, such as hairs, fungi, crumbs etc. It has been found that the known odor filters in vacuum cleaners are not effective enough. It has been found, in particular, that with known vacuum cleaners having an odor filter the exhausted air often smells unpleasantly immediately after the vacuum cleaner has been switched on. This is objectionable to the user and also to the manufacturer of the vacuum cleaner because the user may be given the impression that the vacuum cleaner fails to perform effectively.

SUMMARY OF THE INVENTION

It is an object of the invention to mitigate this problem and, in general, to provide a vacuum cleaner which effectively and reliably removes the odorous components from the air to be exhausted.

According to the invention a vacuum cleaner of the type defined in the opening paragraph has means for temporarily prolonging in operation the residence time in the odor filter of the air drawn through the odor filter during an odor suppression cycle.

Special embodiments of the present invention have been defined in the subsidiary claims.

BRIEF DESCRIPTION OF THE DRAWING

The invention will be described in more detail hereinafter with reference to the accompanying drawing of an exemplary embodiment.

DETAILED DESCRIPTION OF THE PREFERRED EMBODIMENTS

Figure 1:
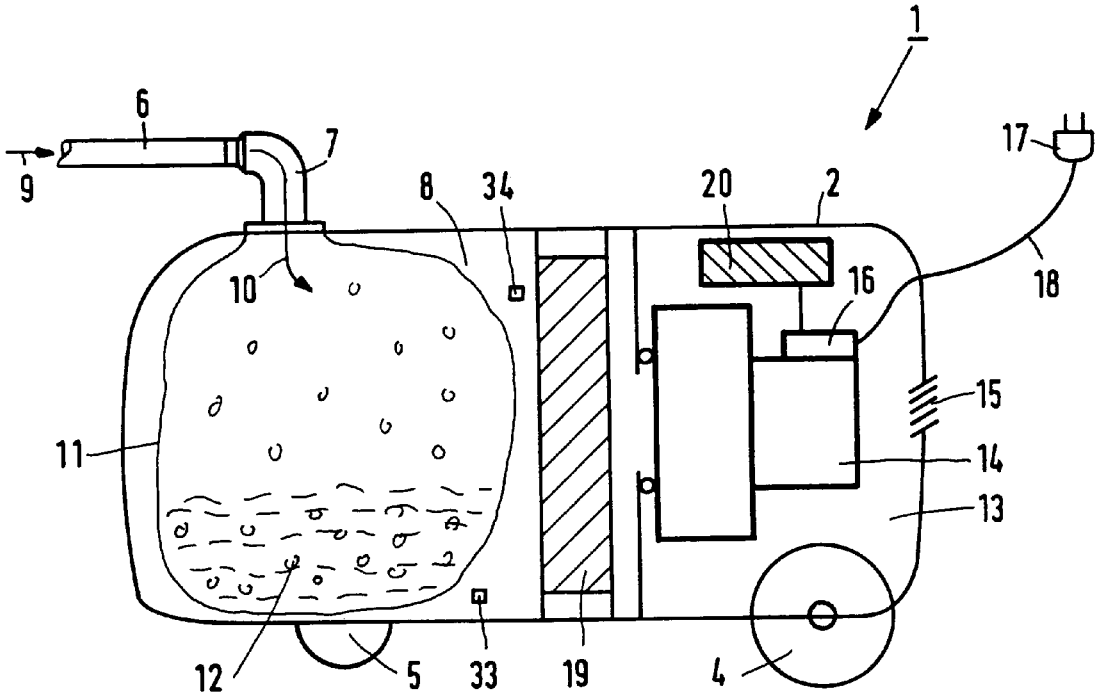
FIG. 1 is a diagrammatic cut-way side view showing a vacuum cleaner embodying the invention.

FIG. 1 is a diagrammatic cut-away side view of a vacuum cleaner 1, of which only those parts which are relevant for a correct understanding of the following description are shown. The vacuum cleaner shown comprises a housing 2, which in customary manner has been provided with wheels or rollers 4, 5. The vacuum cleaner shown is of the so-called "swivel-top" type, in which the air drawn in via a nozzle, not shown, and tubes, not shown, reaches a dust chamber 8 via a hose 6 and a union 7 which is rotatably mounted at the top of the housing 2. However, the present invention can be applied to any type of vacuum cleaner and the drawing merely gives a non-limitative example.

The air stream is represented diagrammatically by means of arrows 9, 10. In the present example the dust chamber accommodates a dust bag or dust cartridge 11, partly filled with dust 12 already picked up.

Behind the dust chamber 8 a motor compartment 13 is disposed, which in customary manner accommodates a motor 14 provided with a fan or impeller, which in operation draws in air via the dust chamber 8, as indicated by the arrows 9, 10. The dust particles carried along with the sucked-in air are left behind in the dust chamber 8, in the present case in the dust bag 11, and the air cleared of dust particles is exhausted via suitably arranged outlet openings 15 at the rear of the housing 2. The motor 14 has been provided with an electrical terminal box 16 with a cord 18 fitted with a plug 17. The terminal box 16 may further accommodate a customary motor control circuit, for example for suction power control and the like.

An odor filter 19, which may be for example an activated-carbon filter, has been arranged between the dust bag 11 and the motor 14. The air leaving the dust chamber 8 has to pass through the odor filter 19 and is thus cleared of any odors components.

As already stated hereinbefore, such an odor filter 19 does not yet provide an optimum removal of odor components from the air leaving the dust chamber 8.

Tests have revealed that in spite of the odor filter a flood of stench may be discharged particularly when the vacuum cleaner is turned on. This is caused by the fact that odorous components can develop freely and accumulate in the dust chamber during the time that the vacuum cleaner is not in use. As a result of this, the air leaving the dust chamber contains a comparatively high concentration of odorous components, which cannot be absorbed completely by the odor filter when the vacuum cleaner is switched on and immediately after this.

Theoretically, this problem could be solved by the use of a thicker filter 19, which would prolong the residence time of the exhaust air in the filter 19 and thereby allow a more complete absorption of odorous components. A drawback of this solution is that apart from an improved absorption of odorous components a thicker filter 19 also leads to a comparatively high air resistance. This increases the risk of overheating of the motor and/or it necessitates a higher motor power. Moreover, the comparatively high air resistance presented by a thicker filter 19 also exists during the operating periods in which the concentration of odorous components is low, as for example some time after the vacuum cleaner 1 has been switched on.

In addition, a thicker filter 19 also requires more space in the vacuum cleaner housing 2. In the case of existing vacuum cleaner designs there is usually no additional space and in the design of new vacuum cleaners the trend is towards an as compact as possible construction.

The invention is based on the recognition of the fact that the highest concentration of odorous components normally occurs when the vacuum cleaner 1 is turned on and immediately after turning on and that subsequently this concentration decreases.

Therefore, it is adequate to prolong the residence time of the air discharged from the dust chamber 8 in the odor filter 19 in a short time interval which starts when the vacuum cleaner 1 is switched on. In accordance with the invention a longer residence time of the odor components in the odor filter 19 immediately after switching on can be obtained by operating the vacuum cleaner 1 with a reduced air displacement upon switching on and briefly after switching on, i.e.

by not allowing the vacuum cleaner motor 14 to operate at full speed immediately after switching on.

In this way, odorous components which have accumulated during the idle time and which are present in a comparatively high concentration in the air to be initially exhausted, can yet be absorbed effectively without a thicker odor filter 19 being required.

A reduced air displacement in a time interval immediately after switching on can be obtained, for example, by means of a suitable control circuit, which limits the motor power to a value below the maximum motor power during a short time after switching on. Such a control circuit is shown diagrammatically at 20 in FIG. 1.

The operation of the circuit 20 bears no relation to the customary suction power control circuit which can be operated by the user and neither bears any relation to the starting circuit, known per se, which serves to preclude turn-on transients in the supply current. Such a starting circuit is known per se from Japanese Patent Application 63-159850 (Matsushita Electric Ind.).

Figure 2:
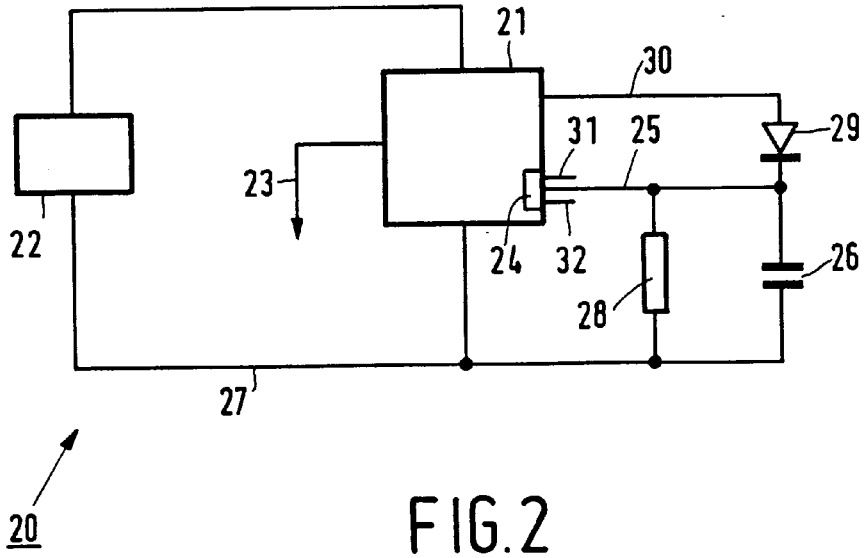
FIG. 2 shows diagrammatically an example of a part of a control circuit for a vacuum cleaner in accordance with the invention.

An example of a control circuit 20 suitable for use in a vacuum cleaner 1 in accordance with the invention is shown diagrammatically in FIG. 2. The present circuit 20 includes a signal processor such as, for example, a microprocessor 21 and a power supply circuit 22. When the vacuum cleaner is switched on the power supply circuit 22 starts to supply power to the microprocessor 21. Subsequently, the microprocessor 21 supplies a control signal via a control line 23, which is connected directly or indirectly to a motor control circuit, which control circuit automatically causes the electric power applied to the motor 14 to be limited to a predetermined value for a predetermined time after switching on.

The predetermined limit value may be set by hand or automatically, as desired, and optionally it may be, for example, constant or vary in accordance with a preselected pattern during the predetermined time. The predetermined time may also be set by hand or automatically.

In a practical embodiment of a vacuum cleaner in accordance with the invention the motor power could be incremented in small steps from an initial value of approximately 10% of the maximum motor power to a value of 25 to 30% of the maximum motor power in a period of, for example, 2 to 3 seconds after switching on. Subsequently, the motor power could be incremented, for example, in steps of 5% to the maximum value or to a manually selected value (for example for suction power control) or an automatically selected value (for example to preclude current transients). The steps may take place, for example, every 100 ms or every 200 ms, as a result of which the final value is reached already after a few seconds.

The microprocessor can simply be programmed in the desired manner.

In order to avoid that the user is given the impression that the vacuum cleaner does not operate correctly an indicator light may be provided to indicate when an odor-suppression cycle has been initiated.

In accordance with the invention a more sophisticated control of the starting power of the motor can be achieved in that allowance is made for other parameters. For this purpose the microprocessor 21 has an input control gate 24 with one or more inputs to which input control signals corresponding to the other parameters can be applied.

In this respect it is to be noted first of all that the starting program required for odor suppression is not or not wholly necessary if after an operating period the vacuum cleaner has only been idle for a short time. This situation occurs, for example, if the user moves the vacuum cleaner from one side of the room to the other side or from one room to another and has to plug into another socket outlet for this purpose. The idle time is then so short that processes which give rise to odorous components cannot yet have caused an annoying build-up of odorous components. The aforementioned predetermined time during which the power applied to the motor is limited is then very short or even zero.

In the diagram given by way of example in FIG. 2 this situation has been allowed for as follows. One of the inputs, i.e. the input 25 of the input control gate 24, is connected to one terminal of a storage capacitor 26, whose other terminal is connected to the neutral line 27 of the power supply circuit 22. A resistor 28 is connected in parallel with the capacitor 26. In a practical example the capacitor 26 may have a capacitance of 470 $\mu$F and the resistor may have a value of 2.2 MΩ.

Moreover, an output 30 of the microprocessor 21 causes the capacitor to be charged directly or indirectly via a diode 29. In the present example the output 30 can charge the capacitor 26 directly (via the diode 29) if the voltage on the output 30 is high. The microprocessor 21 has been programmed in such a manner that the voltage on the output 30 is high when the odor suppression cycle started after switching on of the vacuum cleaner 1 has terminated. As a result, the storage capacitor 26, which may be for example an electrolytic capacitor, is charged to a presettable voltage. Once the capacitor 26 has been charged an input signal with a high level occurs at the input 25. Such a high level prevents the microprocessor 21 from supplying an output control signal which initiates an odor suppression cycle.

When the vacuum cleaner 1 is switched off the storage capacitor 26 will discharge via the resistor 28. After a short idle time of the vacuum cleaner 1 the voltage across the capacitor 26 still exceeds an adjustable threshold value and this voltage is detected as a high level at the input 25. After a longer idle time, however, the storage capacitor 26 can discharge to a value below the threshold value, as a result of which a signal having a low level appears at the input 25. Such a low signal is consequently indicative of a longer idle time, in which enough odorous components may have developed in the dust chamber 8 to make odor suppression desirable when the vacuum cleaner is switched on. Therefore, if the signal at the input 25 of the microprocessor 21 is low when the vacuum cleaner 1 is switched on, the microprocessor 21 initiates the odor suppression cycle. In order to prevent the output 30 from influencing the charge condition of the storage capacitor 26 when the vacuum cleaner 1 is switched on the microprocessor 21 sets this output 30 to a low level upon switching-on. The output 30 is not set to a high level until the odor suppression cycle has been completed.

It is to be noted that instead of a capacitor any other storage element may be used which is capable of producing a time-dependent control signal. An example of this is a digital time measurement circuit, for example a counter, or a temperature-dependent element capable of producing a signal which is related to the motor temperature. However, when a digital time measurement circuit is used a power supply by means of a battery or a capacitor or the like is required.

Instead of or in combination with an idle-time-related control signal other control signals may be applied to one of the inputs of the gate 24, for example to an input 31. Thus, it would be possible, for example, to generate a signal which is related to the degree of filling of the dust chamber 8. Obviously, the odor formation in a nearly full dust chamber 8 may be greater than in a substantially empty dust chamber 8, whereas in the case of an empty dust chamber 8 the initiation of an odor suppression cycle seems to be unnecessary. A signal related to the degree of filling of the dust bag 11 can be obtained, for example, by measuring the pressure difference across an air stream path in the vacuum cleaner 1 or across a part thereof, for example the dust chamber 8, by means of suitable sensors, or by measuring the weight of the dust bag or dust cartridge 8. A sensor for the degree of filling of the dust chamber is shown diagrammatically at 33 in FIG. 1.

Alternatively, an odor sensor or an optical sensor could be used, which in the case of a predetermined concentration of odorous components supplies a control signal to one of the inputs, for example an input 32, of the gate 24 of the microprocessor 21. Such an odor sensor or such an optical sensor is shown diagrammatically at 34 in FIG. 1.

The input gate 24 of the microprocessor 21 can be a simple gate which supplies a high signal if one of the input signals has a high level but alternatively the microprocessor 21 may be adapted to weight the input signals and initiate or does not initiate the odor suppression cycle depending on the result of this weighting. Moreover, the microprocessor 21 may be adapted to select different types of odor suppression cycles depending on the weighting result. The duration of the odor suppression cycle could, for example, be variable depending on the weighting result and/or the rate of increase of the motor power during the odor suppression cycle.

Moreover, 21 could be adapted to detect, in addition to the appearance of a high signal at one or more inputs of the gate 24, a variable, such as for example, the actual amplitude or the frequency or the like of the input signals. On the basis of this information it could be determined whether an odor suppression cycle is to be initiated and, if this is the case, how the cycle should proceed.

It is to be noted that various modifications will be apparent to the expert after the foregoing. Such modifications are assumed to be within the scope of the invention.

What is claimed:

1. A vacuum cleaner, comprising:

a housing;

a suction motor, arranged in the housing, which when in operation draws in air via a suction opening and discharges said air via at least one outlet opening in the housing;

a dust chamber in the housing, in which dust entrained by the drawn-in air is collected during operation;

an odor filter arranged in the housing downstream of the dust chamber; and means for temporarily prolonging the residence time of air in the odor filter when operating to draw air through the odor filter during an odor suppression cycle, wherein said means for prolonging the residence time are adapted to temporarily limit the motor power.

2. A vacuum cleaner as claimed in claim 1, wherein at least one of a length and a nature of the odor suppression cycle depends on one or more parameters relating to operation of the vacuum cleaner in the past.

3. A vacuum cleaner, comprising:

a housing;

a suction motor, arranged in the housing, which when in operation draws in air via a suction opening and discharges said air via at least one outlet opening in the housing;

a dust chamber in the housing, in which dust entrained by the drawn-in air is collected during operation;

an odor filter arranged in the housing downstream of the dust chamber; and means for temporarily prolonging the residence time of air in the odor filter when operating to draw air through the odor filter during an odor suppression cycle, wherein said means for prolonging the residence time include an electronic control circuit for supplying a control signal to a motor control circuit immediately after switching on the vacuum cleaner, in order to limit the motor power.

4. A vacuum cleaner, comprising:

a housing;

a suction motor, arranged in the housing, which when in operation draws in air via a suction opening and discharges said air via at least one outlet opening in the housing;

a dust chamber in the housing, in which dust entrained by the drawn-in air is collected during operation;

an odor filter arranged in the housing downstream of the dust chamber; and means for temporarily prolonging the residence time of air in the odor filter when operating to draw air through the odor filter during an odor suppression cycle, wherein at least one of a length and a nature of the odor suppression cycle depends on one or more parameters relating to operation of the vacuum cleaner in the past, and wherein a length of the odor suppression cycle is zero if the last time that the vacuum cleaner has been switched off corresponds to a predetermined time.

5. A vacuum cleaner, comprising:

a housing;

a suction motor, arranged in the housing, which when in operation draws in air via a suction opening and discharges said air via at least one outlet opening in the housing;

a dust chamber in the housing, in which dust entrained by the drawn-in air is collected during operation;

an odor filter arranged in the housing downstream of the dust chamber; and means for temporarily prolonging the residence time of air in the odor filter when operating to draw air through the odor filter during said odor suppression cycle, wherein at least one of a length and a nature of the odor suppression cycle depends on one or more parameters relating to operation of the vacuum cleaner in the past, and wherein a length of the odor suppression cycle is zero if the dust chamber contains substantially no dust.

6. A vacuum cleaner, comprising:

a housing;

a suction motor, arranged in the housing, which when in operation draws in air via a suction opening and discharges said air via at least one outlet opening in the housing;

a dust chamber in the housing, in which dust entrained by the drawn-in air is collected during operation;

an odor filter arranged in the housing downstream of the dust chamber; and means for initiating an odor suppression cycle which includes means for temporarily prolonging the residence time of air in the odor filter and including an electronic control circuit for supplying a control signal to a motor control circuit to limit the motor power, wherein the electronic control circuit comprises a signal processor having at least one input for an input control signal, and the electronic control circuit is adapted to supply to the motor control circuit an output control signal dependent on the input control signal.

7. A vacuum cleaner as claimed in claim 6, wherein one input of the at least one input for an input control signal is connected to an idle-time detector capable of supplying an output signal which is indicative of a length of time which has expired since the last time that the vacuum cleaner has been switched off.

8. A vacuum cleaner as claimed in claim 7, wherein the idle-time detector comprises a digital time measurement circuit, which is activated when the vacuum cleaner is switched off.

9. A vacuum cleaner as claimed in claim 7, wherein the idle-time detector comprises a storage capacitor, the storage capacitor being charged during normal operation of the vacuum cleaner and which can discharge via a discharging circuit when the vacuum cleaner is idle.

10. A vacuum cleaner as claimed in claim 6, further comprising detection means for detecting a degree of filling of the dust chamber, which detection means supply an input control signal for the signal processor.

11. A vacuum cleaner as claimed in claim 10, wherein said detection means comprise at least one sensor which in operation supplies a signal which depends on a pressure difference.

12. A vacuum cleaner as claimed in claim 6, further comprising at least one odor sensor arranged in or near the dust chamber, which odor sensor supplies an input control signal for the signal processor, which input control signal depends on the concentration of odorous components.

13. A vacuum cleaner as claimed in claim 6, characterized by at least one optical sensor arranged in or near the dust chamber, which optical sensor supplies an input control signal for the signal processor, which input control signal depends on the concentration of the odorous components.

14. A vacuum cleaner as claimed in claim 6, further comprising a temperature-dependent element which supplies an electric input control signal for the signal processor, which input control signal is related to the motor temperature.

15. A vacuum cleaner as claimed in claim 6, wherein the signal processor is adapted to supply a control signal for the motor control circuit which controls the motor power in accordance with one of a plurality of predetermined programs during the odor suppression cycle.

16. A vacuum cleaner as claimed in claim 6, wherein the signal processor has at least two inputs connected to means supplying an input control signal, and the signal processor is adapted to weight an input control signal in order to generate a control signal for the motor control circuit based on the weighting result.

17. A vacuum cleaner as claimed in claim 6, wherein the signal processor is adapted to detect both the presence and a variable of an input control signal.

* * * * *